US009115654B2

(12) United States Patent
Schnell

(10) Patent No.: US 9,115,654 B2
(45) Date of Patent: Aug. 25, 2015

(54) INTERNAL COMBUSTION PISTON ENGINE WITH ENGINE BRAKING BY OPENING OF EXHAUST VALVES

(75) Inventor: Oliver Schnell, Veitsbronn (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 1220 days.

(21) Appl. No.: 13/032,807

(22) Filed: Feb. 23, 2011

(65) Prior Publication Data

US 2011/0203549 A1 Aug. 25, 2011

(30) Foreign Application Priority Data

Feb. 23, 2010 (DE) ..... 10 2010 008 928

(51) Int. Cl.

| | |
|---|---|
| ***F02D 13/04*** | (2006.01) |
| ***F01L 1/18*** | (2006.01) |
| ***F01L 1/26*** | (2006.01) |
| ***F01L 13/06*** | (2006.01) |
| *F01L 1/20* | (2006.01) |
| *F01L 1/047* | (2006.01) |
| *F01L 1/46* | (2006.01) |

(52) U.S. Cl.

CPC ..... *F02D 13/04* (2013.01); *F01L 1/181* (2013.01); *F01L 1/267* (2013.01); *F01L 13/065* (2013.01); *F01L 1/20* (2013.01); *F01L 2001/0476* (2013.01); *F01L 2001/467* (2013.01); *F01L 2105/00* (2013.01); *F01L 2820/033* (2013.01)

(58) Field of Classification Search

CPC ..... F01L 13/06; F01L 1/181; F01L 1/26; F01L 1/08; F01L 1/267; F01L 2001/186

USPC ..... 123/321, 322, 90.12, 90.15–90.18, 123/90.22, 90.43, 90.46, 90.55

See application file for complete search history.

(56) References Cited

U.S. PATENT DOCUMENTS

| | | | | |
|---|---|---|---|---|
| 5,365,916 | A * | 11/1994 | Freiburg et al. | 123/320 |
| 5,645,031 | A * | 7/1997 | Meneely | 123/322 |
| 6,253,730 | B1 * | 7/2001 | Gustafson | 123/321 |
| 6,904,892 | B1 * | 6/2005 | Afjeh et al. | 123/320 |
| 7,013,867 | B2 * | 3/2006 | Rammer et al. | 123/321 |
| 7,712,449 | B1 * | 5/2010 | Schwoerer | 123/321 |
| 7,909,015 | B2 * | 3/2011 | Yang | 123/321 |
| 8,065,987 | B2 * | 11/2011 | Yang | 123/321 |

(Continued)

FOREIGN PATENT DOCUMENTS

EP 0640751 3/1995

*Primary Examiner* — Stephen K Cronin
*Assistant Examiner* — Joseph Dallo
(74) *Attorney, Agent, or Firm* — Volpe and Koenig, P.C.

(57) ABSTRACT

An internal combustion engine including a piston in a cylinder, a cylinder head closing the cylinder, having intake and exhaust channels controlled by at least one intake and exhaust valve. The valves are actuable by a rocker arm or finger lever driven by a camshaft. A brake control device is provided having a hydraulic adjusting piston that opens the exhaust valve additionally and intermittently, a pressure source for hydraulic fluid is associated with the adjusting piston, and the supply to the adjusting piston is controlled by an electrically operable switching valve. A compression relief cam per cylinder/piston assembly is arranged on the camshaft, with the cam being operatively connected to a compression relief rocker arm or finger lever, and the adjusting piston is configured as a coupling pin for connecting the compression relief rocker arm or finger lever, to the rocker arm or finger lever of the exhaust valve.

8 Claims, 4 Drawing Sheets

(56) References Cited

U.S. PATENT DOCUMENTS

| | | | | |
|---|---|---|---|---|
| 8,225,769 | B2 * | 7/2012 | Dilly | 123/321 |
| 2003/0024501 | A1 * | 2/2003 | McCarthy et al. | 123/321 |
| 2006/0005796 | A1 * | 1/2006 | Janak et al. | 123/90.16 |
| 2006/0112918 | A1 * | 6/2006 | Persson | 123/90.16 |
| 2007/0144472 | A1 * | 6/2007 | Yang | 123/90.16 |
| 2008/0210197 | A1 * | 9/2008 | Smith | 123/321 |
| 2010/0006062 | A1 * | 1/2010 | Yang | 123/321 |
| 2010/0024767 | A1 * | 2/2010 | Meneely et al. | 123/323 |
| 2010/0037854 | A1 * | 2/2010 | Yang | 123/321 |
| 2010/0065019 | A1 * | 3/2010 | Yang | 123/321 |
| 2010/0170472 | A1 * | 7/2010 | Yang | 123/321 |
| 2010/0319657 | A1 * | 12/2010 | Dodi et al. | 123/321 |
| 2012/0048232 | A1 * | 3/2012 | Meistrick | 123/321 |

* cited by examiner

INTERNAL COMBUSTION PISTON ENGINE WITH ENGINE BRAKING BY OPENING OF EXHAUST VALVES

CROSS-REFERENCE TO RELATED APPLICATIONS

This application claims the benefit of German Patent Application 102010008928.1, filed Feb. 23, 2010, which is incorporated herein by reference as if fully set forth.

FIELD OF THE INVENTION

An internal combustion piston engine based on a four-stroke process, comprising a crankcase in which at least one cylinder/piston assembly is arranged, the piston being guided through a connecting rod connected to a crankshaft, at least one cylinder head for closing the cylinder, each of whose intake and exhaust channels are controlled by at least one intake valve and one exhaust valve, said intake and exhaust valves being actuable by a rocker arm or a finger lever driven by a camshaft, the rocker arms or finger levers being guided on at least one axle, and further comprising a brake control device comprising at least one hydraulic adjusting piston that engages a component that opens at least the one exhaust valve additionally and intermittently, a pressure source for a hydraulic fluid being associated with the adjusting piston, and the supply to the adjusting piston being controlled by at least one electrically operable switching valve.

BACKGROUND

An internal combustion piston engine of the above-cited type with engine braking by opening of the exhaust valves is known from EP-0 640 751 A2. This brake control device comprises a plurality of components accommodated in an additional housing. The pressure source consists of cylinder/piston assemblies, the piston being actuated by a component of the injection device with which at least one adjusting piston is in hydraulic communication. The adjusting piston for opening one of the exhaust valves is connected to a component that extends through an opening in a bridge member for actuating two exhaust valves. The engine brake for opening one respective exhaust valve of a cylinder has a structure such that, depending on the manner of actuation of the injection device, the exhaust valve opens and closes in the region of the upper dead center of the internal combustion piston engine, this process being intermittent.

A high degree of structural complexity is required for realizing this motor braking because every adjusting piston for opening the exhaust valve necessitates an associated cylinder/piston assembly which is driven by the injection device and affects the periodic opening and closing of the exhaust valve.

Because the described brake control and actuation device is arranged above the rocker arm, it augments the design space requirement of the internal combustion piston engine to a not inconsiderable extent which is likewise not desirable.

SUMMARY

It is therefore an object of the invention to simplify, improve and configure a generic internal combustion piston engine comprising engine braking through opening of the exhaust valves, so that the design space requirement is not augmented and the hydraulic control device can be operated through low forces.

The invention achieves this by the fact that a compression relief cam per cylinder/piston assembly of the internal combustion piston engine is arranged on the camshaft, said cam being operatively connected to a compression relief rocker arm or a compression relief finger lever, and that the adjusting piston is configured as a coupling pin for connecting the compression relief rocker arm or compression relief finger lever to the rocker arm or arms or finger lever or levers of the exhaust valve or valves.

Because the compression relief cam, the compression relief rocker arm or compression relief finger lever are configured and arranged parallel to the cam lever and rocker arm or finger lever of the gas exchange valve, the design space requirement of the internal combustion piston engine remains unchanged. Moreover, the hydraulic system operates only with a low pressure because the adjusting piston as coupling pin requires only an actuating force and not the actual opening force for the exhaust valve or valves.

According to a further feature of the invention, the compression relief cam is arranged next to the exhaust cam or cams or between a plurality of exhaust cams on the camshaft. As a result, no additional design space is required on the camshaft either.

In an advantageous development of the invention, the adjusting piston is operatively connected to cylinders that are fixed on the compression relief finger lever or compression relief rocker arm and on the rocker arm or arms or finger lever or levers of the exhaust valve or valves, said cylinders being at least partially closed at their ends turned away from each other.

One of the cylinders is closed at its turned-away end on which it comprises a pressure fluid connection. The further cylinder comprises on an opposing side, at least one vent bore to avoid deterioration of the installed spring.

According to a further feature, the invention provides arranging an adjusting piston in each cylinder, wherein the adjusting piston which is loadable by the pressure fluid, corresponds to the length of the cylinder, and, when the adjoining piston associated to the spring is situated in the relieved end position of the spring, the front surfaces of the adjusting pistons facing each other are arranged in the parting line between the compression relief finger lever, or compression relief rocker arm, and the adjoining rocker arm or finger lever of the exhaust valve or valves. Through this configuration, it is achieved that in the absence of hydraulic pressure, a coupling of the rocker arms or finger levers situated next to each other does not take place. Through a hydraulic pressure build-up and a displacement of the pressurizable adjusting piston, a locking of the adjoining rocker arms or finger levers and, consequently, an intermittent opening of the exhaust valve in the region of the upper dead center are achieved for producing an additional braking action of the internal combustion engine.

The pressure fluid connection to the adjusting pistons is realized through a bore in the compression relief finger lever or compression relief rocker arm and/or in the finger lever or rocker arm of the exhaust valves, the pressure fluid connection being connected to a pressure fluid supply duct and/or a pressure fluid discharge duct in the axle of the rocker arm or finger lever. In this way a pressurizing of the adjusting piston can be realized with little structural complexity. An electrically actuable control valve is associated to the pressure fluid supply and/or the pressure fluid discharge of each adjusting piston and serves to actuate the adjusting pistons. The pressure fluid supply duct and/or the pressure fluid discharge duct in the axle is divided into galleries associated to the cylinder/piston assemblies of the internal combustion engine and/or to the switching valves. The division of the galleries is obtained by pressing balls or pins into bores of the axle till the balls or pins extend into the pressure fluid supply duct and/or the pressure fluid discharge duct. In this way, each gallery can be controlled by a switching valve. The pressure fluid that usually is engine oil can be supplied through pedestals that engage the axle.

Moreover, a lost motion spring is arranged on a free end of each compression relief finger lever or compression relief rocker arm facing the exhaust valves. The springs assure that the compression relief finger levers or compression relief rocker arms follow the associated compression relief cams and come to be situated at such a point that a coupling to the rocker arms or finger levers of the exhaust valves is possible.

BRIEF DESCRIPTION OF THE DRAWINGS

For further elucidation of the invention, reference is made to the drawings in which one example of embodiment of the invention is shown in simplified illustrations. The figures show.

DETAILED DESCRIPTION OF THE PREFERRED EMBODIMENTS

Figure 1:
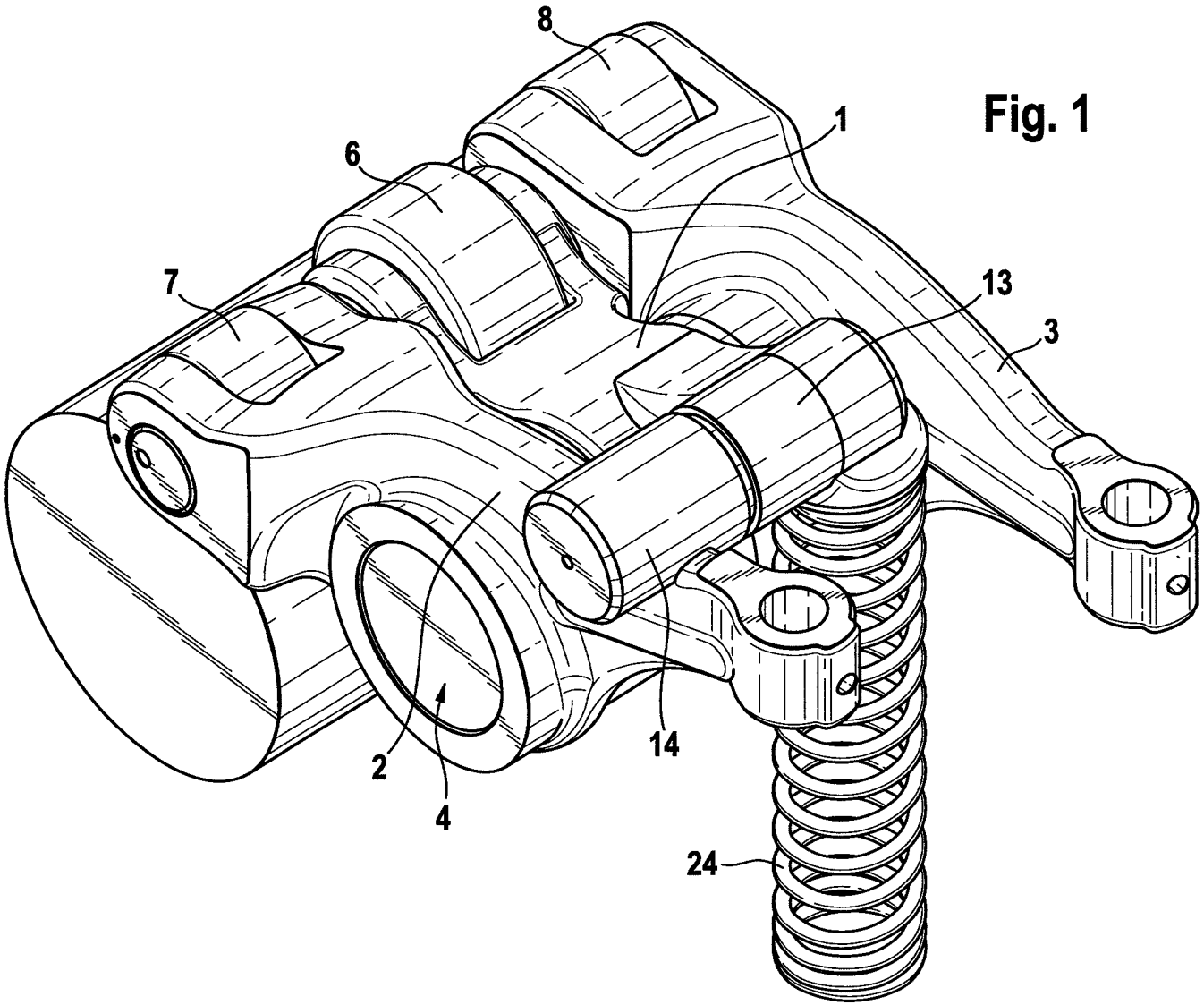
FIG. 1 is a perspective illustration of rocker arms for intake and exhaust valves, and a compression relief rocker arm.

In FIGS. 1 to 4, a compression relief rocker arm, as far as specifically shown, is identified at 1. This compression relief rocker arm is arranged between a rocker arm 2 for the exhaust valves and a rocker arm 3 for the intake valves on an axle 4 which is fixed through pedestals 5 on the internal combustion piston engine, not illustrated. The compression relief rocker arms 1, the rocker arms 2 for the exhaust valves and the rocker arms 3 for the intake valves are connected through rollers 6, 7 and 8 to cams of a camshaft, not illustrated, of the internal combustion piston engine. Through their free ends, the rocker arms 2 for the exhaust valves and the rocker arms 3 for the intake valves engage bridge members 9 and 10 that are supported through their free ends respectively on exhaust valves 11 and 11*a* and on intake valves 12 and 12*a* for operating these. Cylinders 13 are fixed in the region of the ends of the compression relief rocker arms 1 and form, together with cylinders 14 on the rocker arms 2 for the exhaust valves 11, 11*a*, a cylindrical through-passage when the compression relief rocker arms 1 and the rocker arms 2 for the exhaust valves 11, 11*a* are situated in their inoperative position. Adjusting pistons 15 and 16 are arranged respectively in the cylinders 13 and 14 (see FIG. 3). The adjusting pistons 15 fill the cylinders 13 completely, while the adjusting pistons 16, which are arranged in the cylinders 14, comprise a recess for a compression spring 17. The length of the adjusting piston 15 is dimensioned such that, when the compression spring 17 is in its expanded state, the front surfaces between the adjusting pistons 15 and 16 are situated in the parting line between the compression relief rocker arm 1 and the rocker arm 2 for the exhaust valves. Thus, when the adjusting piston 15 is not pressurized and is situated in its position in the cylinder 13, the compression relief rocker arms 1 and the rocker arms 2 for the exhaust valves are uncoupled from each other.

Figure 4:
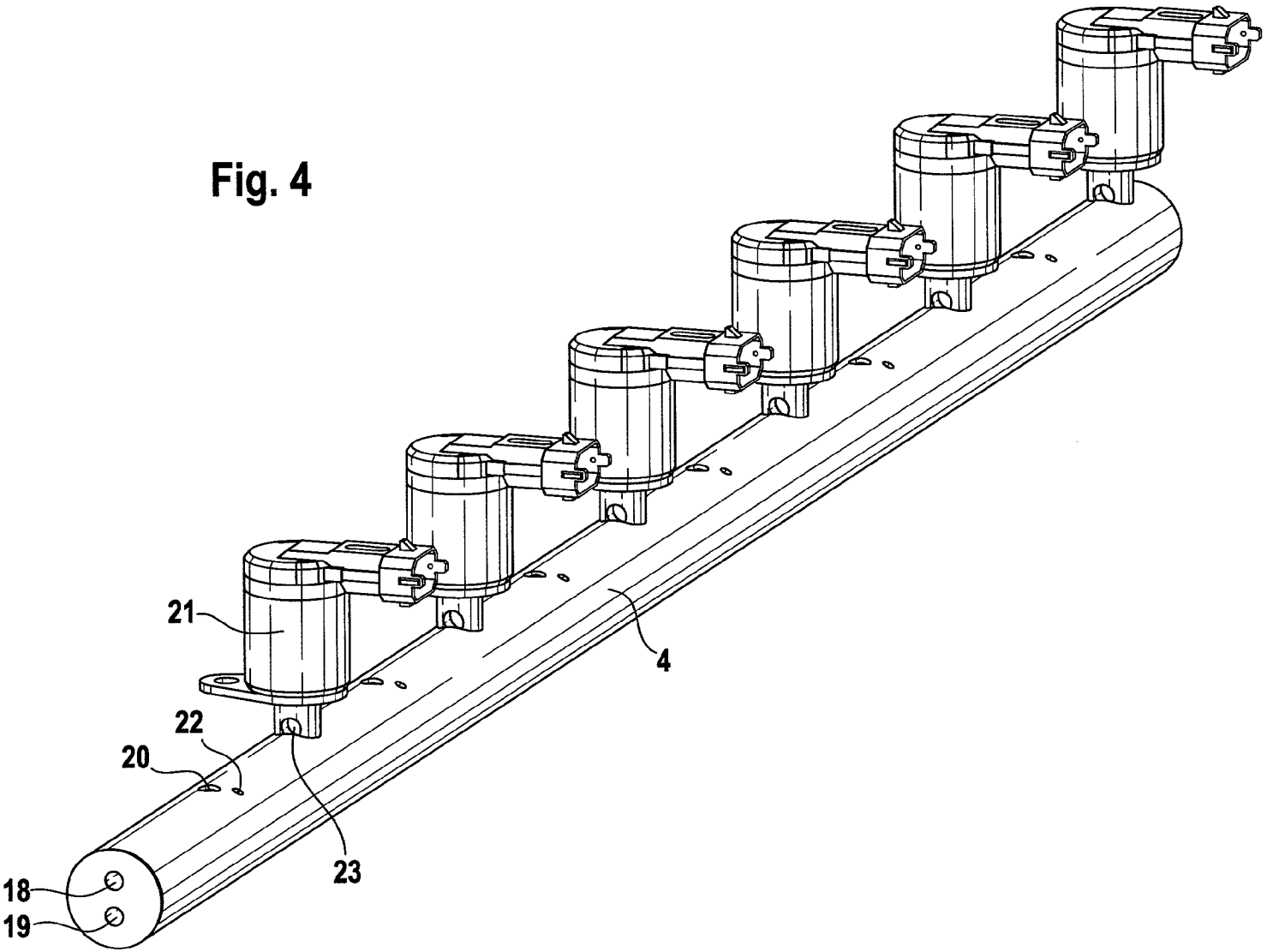
FIG. 4 is a perspective view of an axle for the rocker arms and the compression relief rocker arms, comprising a pressure fluid supply duct and a pressure fluid discharge duct arranged in the axle.

As best depicted in FIG. 4, the axle 4 on which all the rocker arms 1 to 3 are mounted, comprises a pressure medium supply duct 18 and a pressure medium discharge duct 19, at least the pressure medium supply duct is divided into galleries through pressed-in balls 20, and one electrically actuable switching valve 21 is associated with each gallery. Moreover, in correspondence to the spatial arrangement of the compression relief rocker arm 1 on the axle 4, transfer bores 22 are provided in the axle 4. These transfer bores 22 communicate with the pressure medium supply duct 18 so that pressure oil can be transported through the transfer bores 22 and a pressurized fluid connection in the compression relief rocker arms 1 to the front surfaces of the adjusting pistons 15. The switching valves 21 comprise (see FIG. 4) at their connecting points on the axle 4, openings 23 which communicate with connections, not shown, on the pedestals 5 and can thus be supplied with pressurized oil, so that the switching valves 21 control the pressure medium supply to the adjusting pistons 15.

Figure 2:
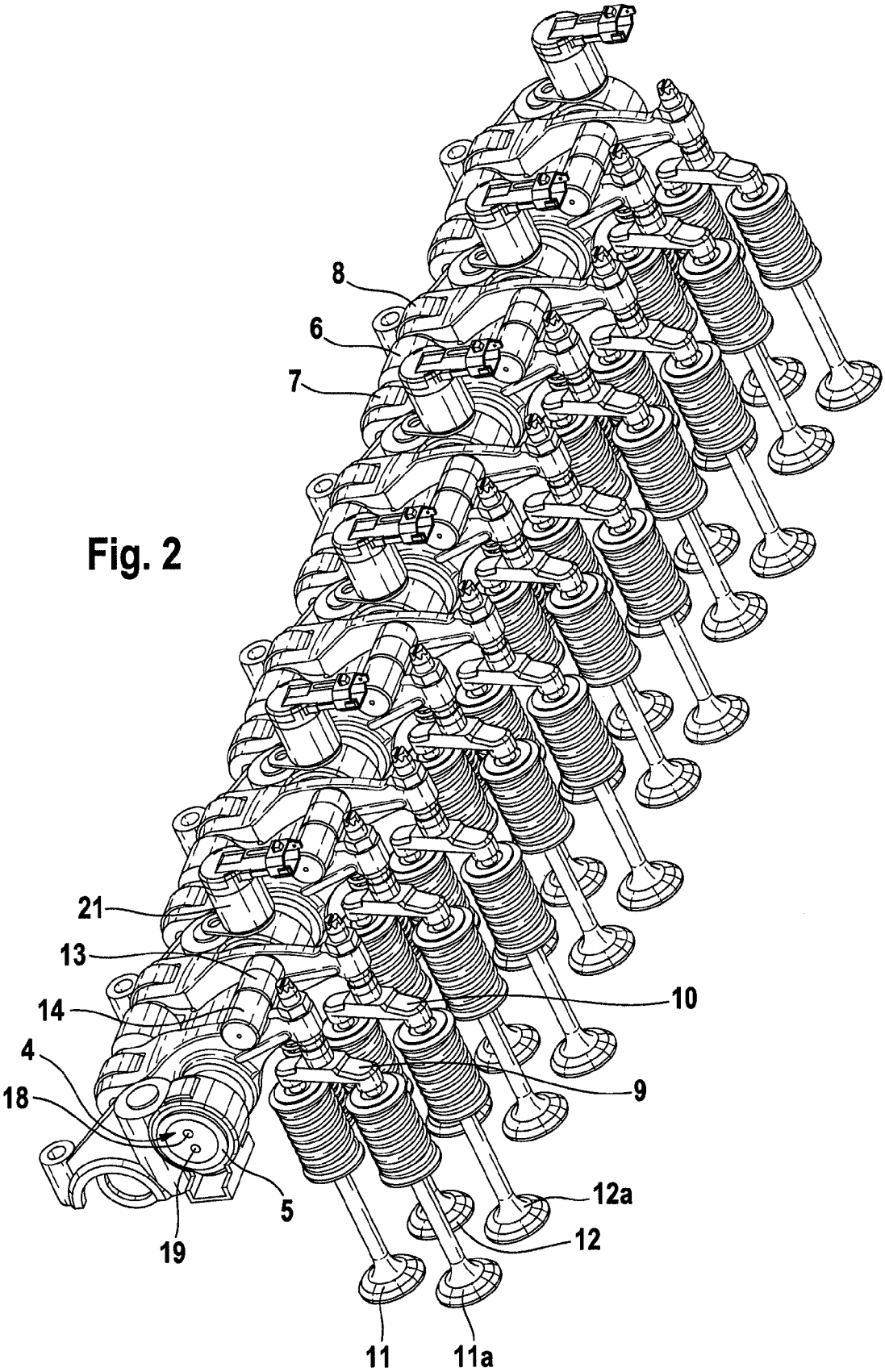
FIG. 2 is a perspective view of a valve train of an internal combustion piston engine comprising 6 cylinder/piston assemblies and two intake valves and two exhaust valves per cylinder.
Figure 3:
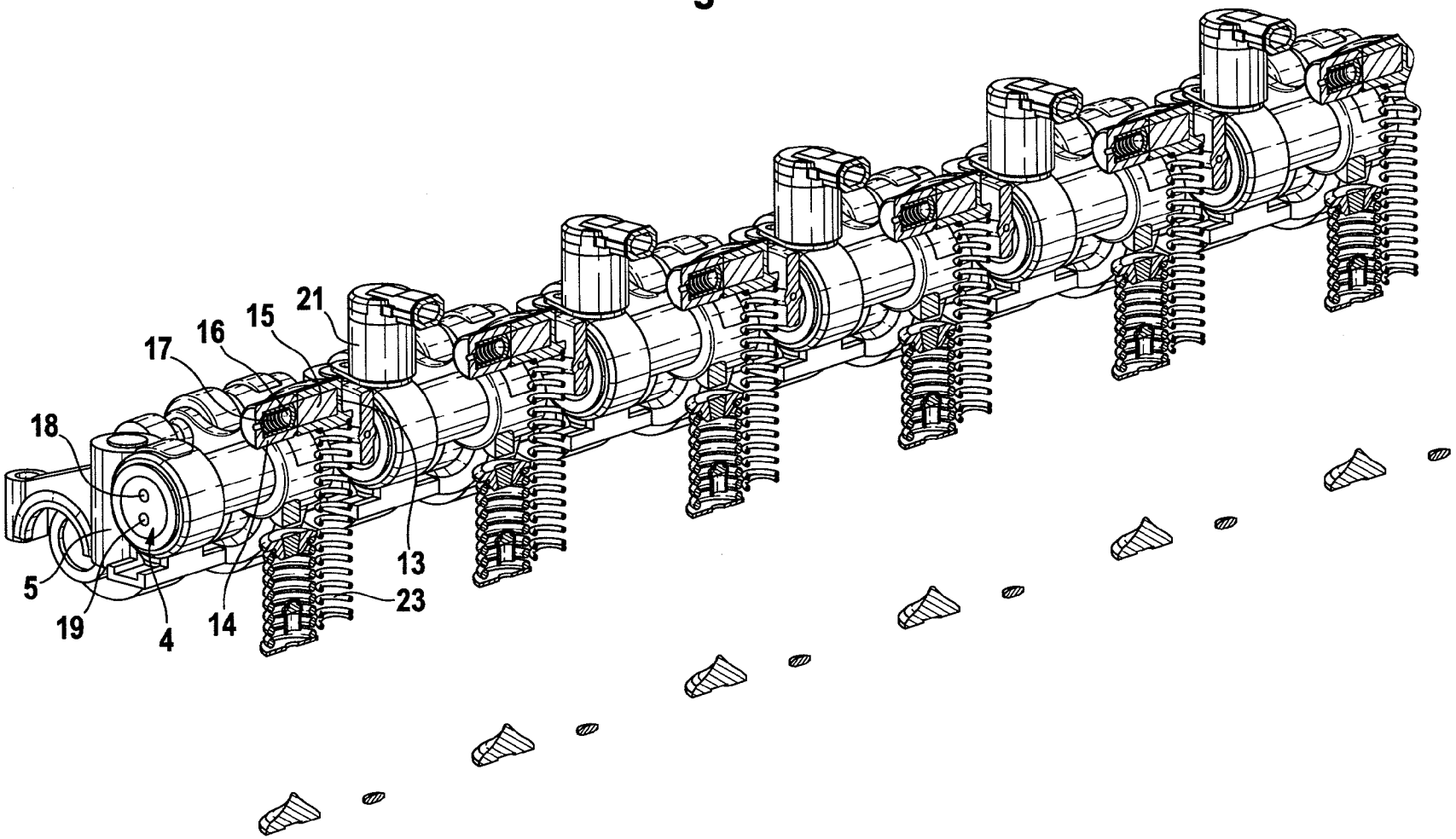
FIG. 3 is a perspective view of a rocker arm bench showing also the adjusting piston and cylinder for coupling.

As best illustrated in FIGS. 1 to 3, the ends of the compression relief rocker arms 1 are engaged by lost motion springs 24 that are supported on the cylinder head or heads, or on another component of the internal combustion piston engine, and load the compression relief rocker arms 1.

As soon as pressure fluid is conveyed through the switching valves to the adjusting pistons 15, i.e. to their front ends, the adjusting pistons are displaced in direction of the adjusting pistons 16 and compress the compression springs 17 thus effecting a coupling of the compression relief rocker arms 1 to the rocker arms 2 of the exhaust valves, so that these, corresponding to the lift of the compression relief cams on the camshaft, cause an additional opening of the exhaust valves to produce an additional braking force of the internal combustion engine.

LIST OF REFERENCE NUMERALS

1 Compression relief rocker arm
2 Rocker arm of exhaust valves
3 Rocker arm of intake valves
4 Axle
5 Pedestal
6, 7, 8 Rollers
9, 10 Bridge members
11, 11*a* Exhaust valves
12, 12*a* Intake valves
13, 14 Cylinders
15, 16 Adjusting pistons
17 Compression spring
18 Pressure medium supply duct
19 Pressure medium discharge duct
20 Balls
21 Switching valves
22 Transfer bores
23 Openings
24 Lost motion springs

The invention claimed is:

1. An internal combustion piston engine based on a four-stroke process, comprising a crankcase in which at least one cylinder/piston assembly is arranged, a piston being guided by a connecting rod connected to a crankshaft, at least one cylinder head for closing a cylinder, each of whose intake and exhaust channels are controlled by at least one intake valve and at least one exhaust valve, each of said intake and exhaust valves being actuable by a rocker arm or a finger lever driven by a camshaft, the rocker arms or finger levers being guided on at least one axle, and further comprising a brake control device comprising at least one hydraulic adjusting piston that engages a component that opens at least one of the exhaust valves additionally and intermittently, a pressure source for a hydraulic fluid being associated with an adjusting piston, and a supply of the hydraulic fluid to the adjusting piston being controlled by at least one electrically operable switching valve, a compression relief cam for each of the at least one cylinder/piston assembly of the internal combustion piston engine is arranged on the camshaft, said compression relief cam being operatively connected to a compression relief rocker arm or a compression relief finger lever, and the adjusting piston is configured as a coupling pin for connecting the compression relief rocker arm or the compression relief finger lever to the rocker arm or arms or finger lever or levers of the exhaust valve or valves, wherein the adjusting piston is operatively connected to cylinders that are fixed on the compression relief rocker arm or the compression relief finger lever and on the rocker arm or arms or finger lever or levers of the exhaust valve or valves, and the cylinders are at least partially closed at ends thereof turned away from each other, with one of the cylinders comprising on an outer end thereof a pressure fluid connection, and another one of the cylinders comprises on a turned-away end thereof a compression spring.

2. An internal combustion piston engine according to claim 1, wherein the compression relief cam is arranged next to an exhaust cam or cams or between a plurality of the exhaust cams on the camshaft.

3. An internal combustion piston engine according to claim 1, wherein an adjusting piston is arranged in each of the cylinders, the adjusting piston is loadable by the pressurized fluid and corresponds to a length of the cylinder, and, when the adjusting piston associated with a compression spring is situated in an end position realized through action of the compression spring, front surfaces of the adjusting pistons facing each other are arranged in a parting line between the compression relief rocker arm, or the compression relief finger lever, and an adjoining one of the rocker arms or the finger levers of the exhaust valve or valves.

4. An internal combustion piston engine according to claim 1, wherein the pressure fluid connection of the adjusting piston is provided via bores in at least one of the compression rocker arm or the compression relief finger lever, or in the rocker arm or finger lever of the exhaust valves, which are operatively connected to at least one of a pressure fluid supply duct or a pressure fluid discharge duct in the axle.

5. An internal combustion piston engine according to claim 4, wherein at least one of the pressure fluid supply or the pressure fluid discharge of each of the adjusting pistons is actuated by a respective electrically actuable control valve.

6. An internal combustion piston engine according to claim 5, wherein the at least one of the pressure fluid supply duct or the pressure fluid discharge duct in the axle is divided into galleries associated to the switching valves.

7. An internal combustion piston engine according to claim 6, wherein a division of the galleries is obtained by pressing balls or pins into bores of the axle until the balls or pins extend into the at least one of the pressure fluid supply duct or the pressure fluid discharge duct.

8. An internal combustion piston engine according claim 1, wherein a free end of the compression relief rocker arm or the compression relief finger lever facing the exhaust valves is loaded in closing direction of the exhaust valves through a lost motion spring.

* * * * *